US006087609A

United States Patent [19]

Thilker et al.

[11] Patent Number: 6,087,609

[45] Date of Patent: Jul. 11, 2000

[54] CIRCUIT BREAKER, ARCING CHAMBER HOUSING FOR A CIRCUIT BREAKER AND HOUSING MODULE FOR AN ARCING CHAMBER HOUSING

[75] Inventors: Lutz Thilker, Leichlingen; Wolfgang Erven, Hilden; Klaus Jung, Bonn, all of Germany

[73] Assignee: Kloeckner-Moeller-GmbH, Bonn, Germany

[21] Appl. No.: 09/230,577

[22] PCT Filed: Jul. 18, 1997

[86] PCT No.: PCT/EP97/03863

§ 371 Date: Sep. 23, 1999

§ 102(e) Date: Sep. 23, 1999

[87] PCT Pub. No.: WO98/05049

PCT Pub. Date: Feb. 5, 1998

[30] Foreign Application Priority Data

Jul. 27, 1996 [DE] Germany ..... 196 30 471

[51] Int. Cl.[7] ..... H01H 33/02; H01H 9/02

[52] U.S. Cl. ..... 218/22; 200/303; 218/31; 218/155; 218/156

[58] Field of Search ..... 200/243, 244, 200/303; 218/22, 23, 24, 25, 26, 27, 28, 29, 30, 31, 32, 33, 34–39, 117, 146, 147, 149–151, 154, 155, 156; 335/16, 147, 195, 201, 202

[56] References Cited

U.S. PATENT DOCUMENTS

| | | | |
|---|---|---|---|
| 2,100,753 | 11/1937 | Shofield et al. | 218/113 |
| 4,649,247 | 3/1987 | Preuss et al. | 200/244 |
| 4,675,481 | 6/1987 | Markowski et al. | 218/1 |
| 4,910,485 | 3/1990 | Bolongeat-Mobleu et al. | 335/195 |
| 4,916,421 | 4/1990 | Pardini et al. | 335/16 |
| 5,029,301 | 7/1991 | Nebon et al. | 218/146 |
| 5,281,776 | 1/1994 | Morel et al. | 218/152 |
| 5,313,180 | 5/1994 | Vial et al. | 218/31 X |
| 5,357,066 | 10/1994 | Morel et al. | 218/154 |
| 5,534,832 | 7/1996 | Duchemin et al. | 218/22 X |

FOREIGN PATENT DOCUMENTS

| | | |
|---|---|---|
| 174 904 | 3/1986 | European Pat. Off. . |
| 314 540 | 5/1989 | European Pat. Off. . |
| 542 636 | 5/1993 | European Pat. Off. . |
| 89 03 836 | 5/1989 | Germany . |

*Primary Examiner*—J. R. Scott
*Attorney, Agent, or Firm*—Kenyon & Kenyon

[57] ABSTRACT

A arcing chamber housing is disclosed for a circuit breaker with a double turning contact breaker. The arcing chamber housing (1) is composed of two housing modules (2, 3) and an extinguishing chamber (19) is arranged in the area of the fixed contact pieces (6, 7) to extinguish the arcs which are formed between the contact pieces of the double turning contact breaker. In order to obtain a arcing chamber housing (1) which is easy and economical to produce, with extinguishing chambers (19) which have a reproducible extinguishing behavior once the arcing chamber is assembled, the two housing modules (2, 3) are substantially L-shaped parts whose inner marginal surfaces (4, 5) face each other. The first parts (17, 18) of the housing, which correspond to the first branches of the L-shaped housing modules (2,3), are designed as extinguishing chambers (19). Also disclosed are the housing modules (2, 3) used to produce such a arcing chamber housing.

9 Claims, 2 Drawing Sheets

CIRCUIT BREAKER, ARCING CHAMBER HOUSING FOR A CIRCUIT BREAKER AND HOUSING MODULE FOR AN ARCING CHAMBER HOUSING

FIELD OF THE PRESENT INVENTION

The invention relates to an arcing chamber housing for a circuit breaker having a rotary double-break interrupter. The present invention relates furthermore to housing modules for manufacturing an arcing chamber housing of this kind.

BACKGROUND OF THE INVENTION

Arcing chamber housings which are designed for circuit breakers and are able to be assembled from two separate housing modules for each power supply phase are disclosed, for example in European Patent No. B 1-542 636. These housings can be assembled simply and quickly. In addition, it is merely the relatively small arcing chamber housing that needs to be made of an arc-resistant material. On the other hand, the housing which is placed over the arcing chamber housings that correspond in number to the number of phases, can be made of a less expensive material. The disclosed housing modules are essentially constituted of two saucer-shaped housing parts, symmetrically disposed with respect to the median plane in the longitudinal direction of the arcing chamber housing. To assemble the arcing chamber, initially the contact members, arc splitters, etc. are arranged in one of the two saucer-shaped housing modules, and the second housing module, as the case may be, is then placed upon the first housing module and joined, e.g., riveted thereto. The disadvantage of the known arcing chamber housings is, inter alia, that the extinction chambers of arcing chamber housings of this kind are first formed when the two housing modules are joined. For that reason, it is not possible, as a rule, to perform a complete test for correct functioning of the extinction chambers prior to their assembly. To eliminate sources of error, in particular in the arcing chambers, it is often necessary to disassemble the entire arcing chamber when known arcing chamber housings are used.

SUMMARY OF THE INVENTION

An object of the invention is to indicate an arcing chamber housing which is capable of being assembled from two housing modules and which has the advantages of known housings of this kind, is simple and inexpensive, and in which the extinction chambers, following assembly of the arcing chambers, have reproducible arc-quenching performance characteristics. In addition, the intention is to provide housing modules capable of being used for manufacturing arcing chamber housings of this kind.

The present invention provides an arcing chamber housing in which the arcing chamber housing is to be assembled from two essentially L-shaped housing modules, whose first housing part corresponding to a first limb is designed as an extinction chamber.

It is preferable that the two interconnected housing modules have an identical construction, so that there is no need for them to be manufactured and stockpiled separately.

The present invention also provides a housing module in which a first housing part that constitutes the first limb of the L-shaped housing module is designed as extinction chamber (19). One of the stationary contact members, as well as the arm of the rotatable contact member assigned to the stationary contact member in question are arranged inside the extinction chamber, and the second housing part of the housing module that constitutes the second limb is designed as a bearing block for a shaft that actuates the rotatable contact member.

In this context, the side walls of the second housing part forming the second bearing block are expediently provided with semicircular openings.

A significant advantage of the arcing chamber housings of the present invention is that, in each housing module, prior to assembling the arcing chamber housing, the appropriate arcing chamber can be completely preassembled, together with its arc splitters and, if indicated, tested for its functioning.

The same applies to the two stationary contact members and the rotatable contact member. In this context, depending on the design of the L-shaped housing module and of the contact members, the two stationary contact members can each be permanently preassembled in one housing module, or both contact members together in only one housing module. In the second case then, assembling the arcing chamber housing merely requires securing the second housing module, as the case may be, together with the corresponding arcing chamber, to the first housing module having the otherwise completely installed rotary double-break interrupter.

In one advantageous specific embodiment, the housing modules are designed at the same time to be supporting structures for the rail-shaped conductors arranged between the stationary contact member in question and the connecting terminal in question.

For this, provision is made at the edges, on one or both outer sides of the first housing part, for depressions, into which are insertable corresponding rail-shaped conductors having a loop form, in particular having connecting cross-pieces at the extremities. In another specific embodiment of the present invention, a depression is also provided on the outer side of the second housing part as well, in the edge area facing away from the first housing part. A partial section of the rail-shaped conductor arranged between the stationary contact member in question and the corresponding connecting terminal can also be inserted in this depression.

It is practical for the housing module to be made of a molded plastic article.

BRIEF DESCRIPTION OF THE DRAWINGS

The following exemplary embodiments reveal further details and advantages of the invention, as elucidated on the basis of the Figures, which show.

DETAILED DESCRIPTION

Figure 1:
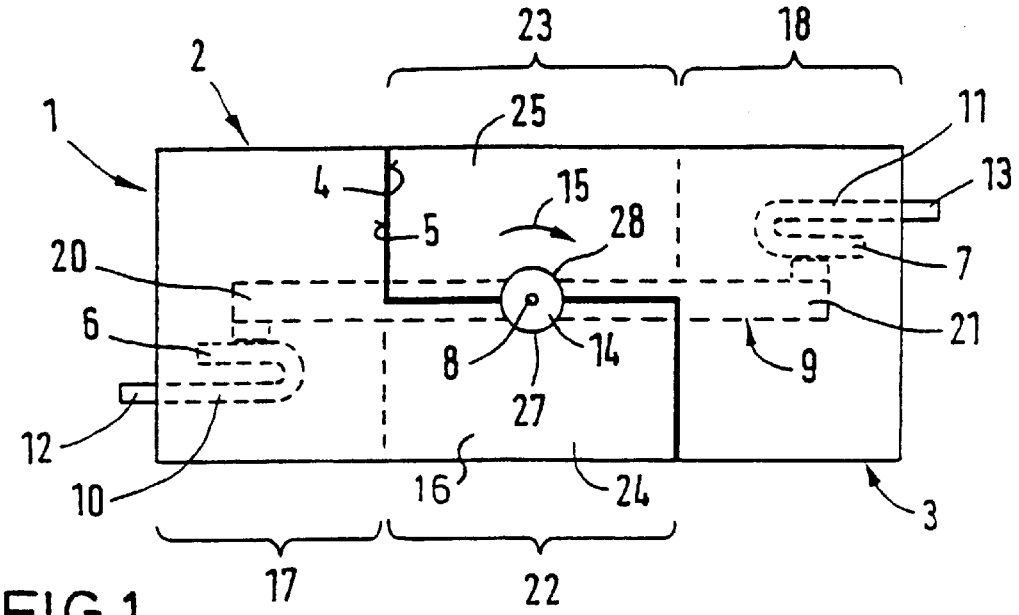
FIG. 1 illustrates the side view of a first exemplary embodiment of an arcing chamber housing of the present invention, including contact members shown with dotted lines.

In FIG. 1, 1 denotes an arcing chamber housing, which is composed of two same, L-shaped housing modules 2 and 3, whose inner boundary surfaces 4, 5 face one another. The housing modules are made, for example, from a suitable molded plastic article.

Figure 2:
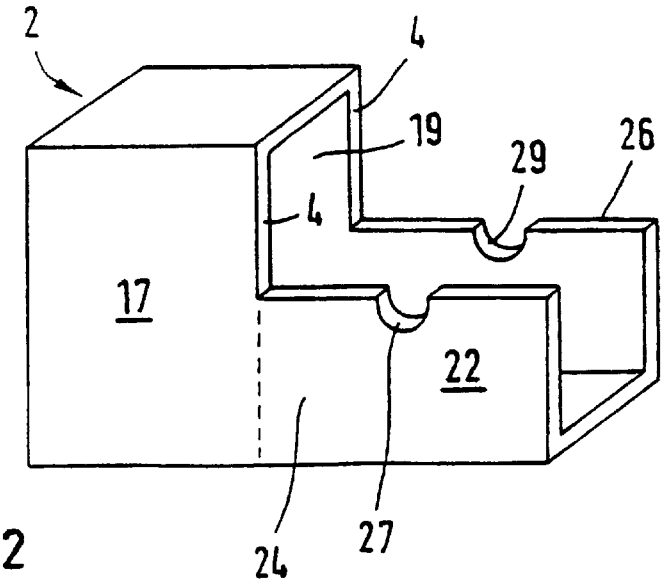
FIG. 2 illustrates a perspective view of one of the two housing modules of FIG. 1.

Located in arcing chamber housing 1 is a generally known rotary double-break interrupter, which essentially includes two stationary contact members 6, 7 and a contact member 9 that is rotatable about a shaft 8 and that jumpers the two stationary contact members. Stationary contact members 6, 7 are each connected via rail-shaped conductors 10, 11 to corresponding connecting terminals 12, 13. A shaft 14 enables the rotatable contact member 9 to swivel in the direction of arrow 15. To drive shaft 14, or to couple shaft 14 to corresponding rotary double-break interrupters, connected in parallel, for additional phases, shaft 14 is led through side wall 16 of arcing chamber housing 1. First housing part 17 or 18 corresponding to the first limb, shown vertically, of the L-shaped housing module 2 or 3 in question, contains in each case an arcing chamber 19 (FIG. 2), with stationary contact member 6 or 7, as well as arm 20 or 21 of rotatable contact member 9 associated with this contact member being arranged within this arcing chamber 19. Second housing part 22 or 23 of housing module 2 or 3 in question forming the second limb, shown horizontally, is designed as a bearing block for shaft 14 of rotatable contact member 9, side walls 24, 26 or 25 of second housing part 22 or 23 forming the bearing block having semicircular openings 27, 29 or 28, which surround shaft 14.

Assembling the entire arcing chamber housing 1 is a simple operation: the arc splitters (not shown) and stationary contact members 6, 7 having rail-shaped conductors 10, 11 are inserted and installed in the two finished housing modules 2, 3; and, if indicated, the functioning of arcing chambers 19 is tested. In addition, in one of the two housing parts 22, 23, rotatable contact member 9 is inserted and, if indicated, secured. The two housing modules 2, 3, including the preassembled switching contact parts are then joined together, for example, screw-coupled, riveted, latched or welded together.

The present invention is, of course, not limited to the exemplary embodiment described above. It is not necessary that the two housing modules have an exact L-shaped form. It is, rather, customary for the outer contour of the housing modules, in particular, to deviate from the L-shape, to enable the arcing chamber housing to be inserted into the corresponding housing placed above it.

Figure 3:
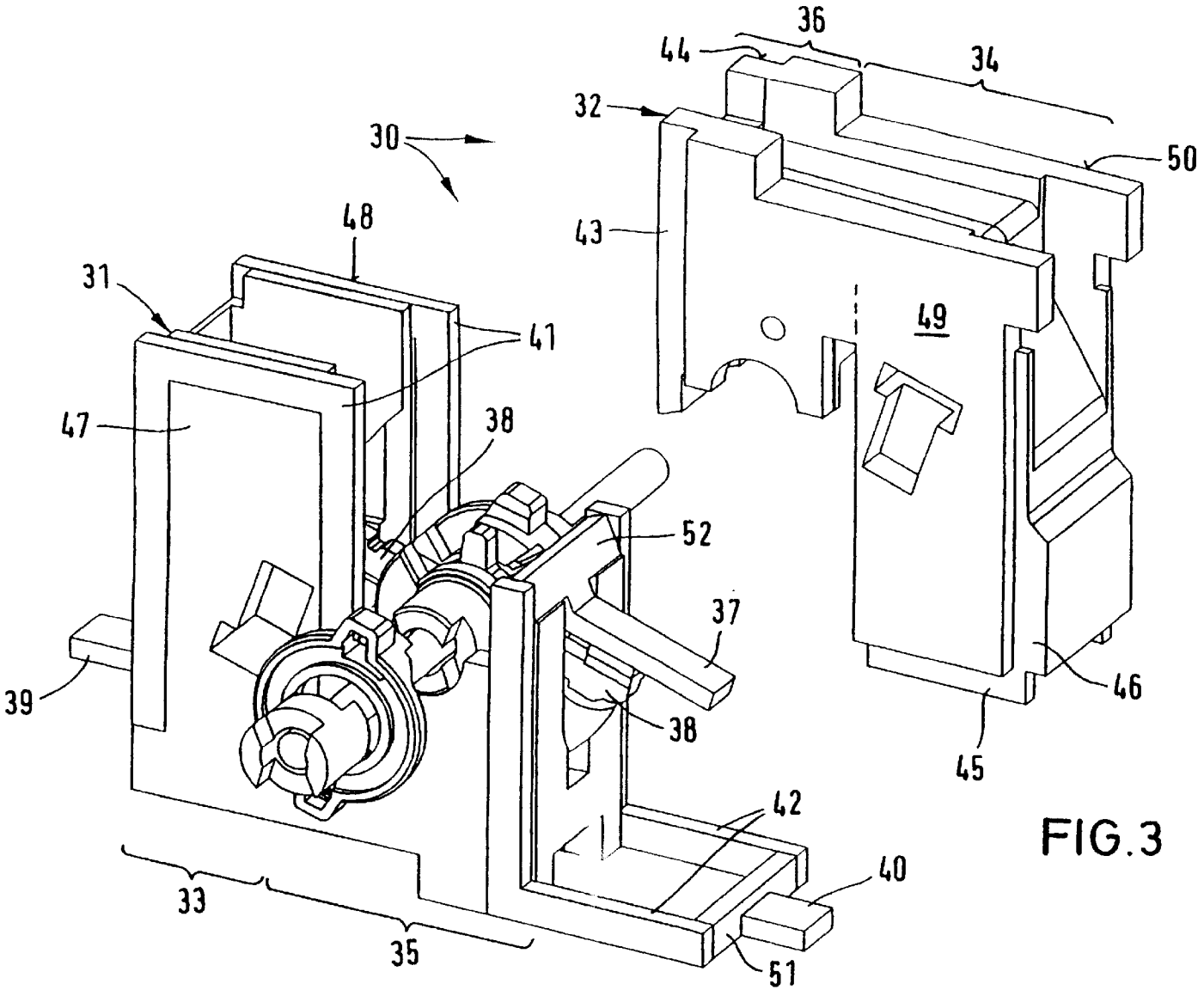
FIG. 3 illustrates a perspective view of a second exemplary embodiment of an arcing chamber housing of the present invention prior to assembling the two housing modules, both the stationary contact members as well as the rotatable contact member being completely preassembled on one housing module.

Moreover, the housing does not have to be designed to accommodate the rail-shaped conductors in the arcing chamber as well. It has proven to be advantageous, for example, when working with relatively long conductors, to use the particular intended housing module as a supporting structure for the conductors that are able to be mounted on the exterior of the housing module in question. An exemplary embodiment of this kind is shown in FIG. 3:

In this instance, arcing chamber housing, denoted by 30, is made up, in turn, of two identical, essentially L-shaped housing modules 31, 32. Each housing module 31 or 32 has, respectively, a first housing part 33 or 34, and a second housing part 35 or 36. Of the two stationary contact members 37, only the contact member on the right is visible in FIG. 3, the other contact member is arranged inside first housing part 33. The design of housing modules 31, 32 is such that both the two stationary contact members 37, as well as rotatable contact member 38 are able to be optionally preassembled on one of the two housing modules 31, 32 to be joined together. The other housing module in each case still contains then merely an extinction chamber, in some instances with arc splitters.

In the depicted exemplary embodiment, rail-shaped conductors 41, 42 connecting stationary contact members 37 and connecting terminals 39, 40 are each conceived as U-shaped or L-shaped double loops, to be arranged in edge-side depressions 45, 46 or 43, 44 on outer sides 47, 48 or 49, 50 of first or second housing part 33, 34 or 35, 36. In this context, the loop ends are interconnected via conductive connecting crosspieces 51, 52.

What is claimed is:

1. An arcing chamber housing for a circuit breaker comprising:

a first housing module, the first housing module being essentially L-shaped and having a first housing limb; and a second housing module, the second housing module being essentially L-shaped and having a second housing limb and an inner edge surface, the inner edge surface facing the first housing module, the first and second housing modules for housing a rotary double-break interrupter of the circuit breaker, the rotary double-break interrupter including a first and a second stationary contact member connected via rail-shaped conductors to respective first and second connecting terminals, the rotary double-break interrupter including a two-arm rotatable contact member rotatable about a shaft for connecting in a closed position the first and second stationary contact members, the first and second stationary contact members in response to an overload situation for swivelling the rotatable contact member into an open position;

the first and second housing limbs each forming an arc extinction chamber for the rotary double-break interrupter in an area of the first and second stationary contact members.

2. The arcing chamber housing as recited in claim 1 wherein the first and second housing modules are identical.

3. An L-shaped housing module for an arcing chamber housing comprising:

a first housing part forming a first limb, the first limb including an arc extinction chamber for a rotary double-break interrupter, the first limb for housing a stationary contact member and an arm of a rotatable contact member of the rotary double-break interrupter; and a second housing part forming a second limb, the second limb including a bearing block for a shaft for actuating the rotatable contact member.

4. The housing module as recited in claim 3 wherein the second housing part has side walls having semicircular openings.

5. The housing module as recited in claim 3 wherein the first housing part has at least one outer side having an edge-side depression for supporting a rail-shaped conductor having a loop form between the stationary contact member and a corresponding connecting terminal.

6. The housing module as recited in claim 5 wherein the outer side is capable of supporting a second rail-shaped conductor having a loop form, the second rail-shaped conductor for interconnection via a connecting crosspiece to the rail-shaped conductor.

7. The housing module as recited in claim 5 wherein the second housing part has at least one second outer side with a second edge-side area facing away from the first housing part and having a second depression for at least one partial section of the rail-shaped conductor.

8. The housing module as recited in claim 5 wherein the housing module is made of a molded plastic.

9. A circuit breaker comprising:

a rotary double-break interrupter including a first and a second stationary contact member and a two-arm rotatable contact member rotatable about a shaft for connecting in a closed position the first and second stationary contact members, the first and second stationary contact members in response to an overload situation for swivelling the rotatable contact member into an open position;

a first housing module, the first housing module being essentially L-shaped and having a first housing limb; and a second housing module, the second housing module being essentially L-shaped and having a second housing limb and an inner edge surface, the inner edge surface facing the first housing module, the first and second housing modules for housing the rotary double-break interrupter, the first and second housing limbs each forming an arc extinction chamber in an area of the first and second stationary contact members.

* * * * *

UNITED STATES PATENT AND TRADEMARK OFFICE

CERTIFICATE OF CORRECTION

PATENT NO. : 6,087,609
DATED : July 11, 2000
INVENTOR(S) : Thilker et al.

It is certified that error appears in the above-identified patent and that said Letters Patent is hereby corrected as shown below:

Column 1,
Line 6, change "FIELD OF THE PRESENT INVENTION" to -- FIELD OF THE INVENTION --.
Line 7, before "… invention …" insert -- present --.
Line 17, change "… example …" to -- example, --.

Signed and Sealed this

Thirtieth Day of November, 2004

JON W. DUDAS
*Director of the United States Patent and Trademark Office*